US006564574B1

(12) United States Patent
Pereira et al.

(10) Patent No.: US 6,564,574 B1
(45) Date of Patent: May 20, 2003

(54) SEALED UNIT OF REFRIGERANT FLUID FOR A REFRIGERATION APPLIANCE

(75) Inventors: Roberto Horn Pereira, Joinville (BR); Ingwald Vollrath, Joinville (BR)

(73) Assignee: Empresa Brasileira de Compressores S.A. -EMBRACO, Joinville (BR)

( * ) Notice: Subject to any disclaimer, the term of this patent is extended or adjusted under 35 U.S.C. 154(b) by 0 days.

(21) Appl. No.: 10/089,634

(22) PCT Filed: Oct. 4, 2000

(86) PCT No.: PCT/BR00/00110

§ 371 (c)(1),
(2), (4) Date: Mar. 28, 2002

(87) PCT Pub. No.: WO01/25703

PCT Pub. Date: Apr. 12, 2001

(30) Foreign Application Priority Data

Oct. 6, 1999 (BR) ..... 9905267

(51) Int. Cl.[7] ..... F25B 39/04; F25B 1/00; F25B 3/00; F25D 3/08; F25D 19/00

(52) U.S. Cl. ..... 62/498; 62/508; 62/499; 62/298; 62/371; 165/76; 165/148; 165/163

(58) Field of Search ..... 62/298, 371, 498, 62/499, 508; 165/76, 148, 163

(56) References Cited

U.S. PATENT DOCUMENTS

| | | | | |
|---|---|---|---|---|
| 2,737,780 A | | 3/1956 | Curell, Jr. | 62/4 |
| 3,555,848 A | * | 1/1971 | Johnson | 62/457.9 |
| 4,321,803 A | * | 3/1982 | Smith | 62/507 |
| 6,457,320 B1 | * | 10/2002 | Nishikawa et al. | 62/259.1 |

FOREIGN PATENT DOCUMENTS

| | | | |
|---|---|---|---|
| GB | 1556417 | 11/1979 | F25D/11/00 |
| WO | 93/01459 | 1/1993 | F25B/41/06 |

* cited by examiner

*Primary Examiner*—William C. Doerrler
*Assistant Examiner*—Filip Zec
(74) *Attorney, Agent, or Firm*—Darby & Darby

(57) ABSTRACT

A sealed unit of refrigerant fluid for a refrigeration appliance, comprising a hermetic compressor (1), a condenser (3), an evaporator (2), an expanding device, and conducting tube (4) of refrigerant fluid, at least one of the parts consisting of the condenser (3) and the evaporator (2) being defined as a prismatic body which is at least partially tubular, the component parts of the sealed unit being relatively displaced from an inoperative position of transportation, in which the hermetic compressor (1) and the conducting tubes (4) remain contained within a contour defined by the contour of at least one of the parts consisting of the condenser (3) and the evaporator (2), to a mounting operative position in a refrigeration appliance.

10 Claims, 3 Drawing Sheets

SEALED UNIT OF REFRIGERANT FLUID FOR A REFRIGERATION APPLIANCE

FIELD OF THE INVENTION

The present invention refers to a construction for the sealed unit of refrigerant fluid for a refrigeration appliance, to be particularly used in refrigeration appliances in which the evaporator, when in a refrigeration position, is mounted distant from both the compressor and the condenser.

BACKGROUND OF THE INVENTION

The refrigeration appliances have a sealed unit comprising a compressor, a condenser, an evaporator and conducting tubes of refrigerant fluid connecting the compressor to the condenser, the latter to the evaporator, which is on its turn connected to the compressor. The sealed unit is usually mounted and sealed at the same manufacturing place of the cabinet into which it will be installed, in order to facilitate handling and transportation of said sealed units between their mounting station and the installation station of said cabinet.

In the constructions in which the assembly of the sealed unit occurs away from the cabinet manufacturing station, said sealed units have to be transported to said station, in order to be installed in said cabinets. With the conventional constructions, in order to transport the sealed units, each of them has to be packed in an appropriated package, involving all the components in the form they are found to be installed in a cabinet, i.e., in an operative position of refrigeration and in such a way as to protect said components.

Besides requiring a respective complex and bulky package, each sealed unit should have a structure capable of supporting, in a safe and stable way, the evaporator which, in the operative position of the sealed unit, stays away from the compressor-condenser assembly and is affixed to the components of said assembly only by means of the conducting tubes of refrigerant fluid.

The great volume of the package required for each sealed unit results in high cost, disproportionate to the volume which is effectively used for packaging the components, making infeasible to manufacture the cabinets in stations distant from that used for mounting the sealed units.

This problem is not so critical when the sealed units have their components closer to each other, but it is very relevant when the distance between the evaporator and the compressor-condenser assembly is large, as it occurs in the vertical refrigeration appliances.

DISCLOSURE OF THE INVENTION

Thus, it is an object of the present invention to provide a construction for the sealed unit of refrigerant fluid for a refrigeration appliance of reduced cost, which permits easy transportation and handling, and which may be mounted in a station distant from the manufacturing station of the refrigeration cabinet into which it will be installed. These and other objectives are achieved by a sealed unit of refrigerant fluid for a refrigeration appliance, comprising component parts defined by a hermetic compressor, a condenser, an evaporator and conducting tubes of refrigerant fluid connecting the hermetic compressor to the condenser, the latter to the evaporator by means of an expanding device, and connecting the evaporator to the hermetic compressor, at least one of the parts consisting of the condenser and the evaporator being defined as a prismatic body which is at least partially tubular, said component parts of the sealed unit being relatively displaced from an inoperative position of transportation, in which the hermetic compressor and the conducting tubes remain contained within a contour defined by the contour of at least one of the parts defined by the condenser and the evaporator, to a mounting operative position in a refrigeration appliance, in which the evaporator and part of the extension of the conducting tubes connecting said evaporator to the hermetic compressor and to the condenser are displaced to a position external to said contour.

BRIEF DESCRIPTION OF THE DRAWINGS

The invention will be described below, with reference to the attached drawings, in which.

BEST MODE OF CARRYING OUT THE INVENTION

Figure 1:
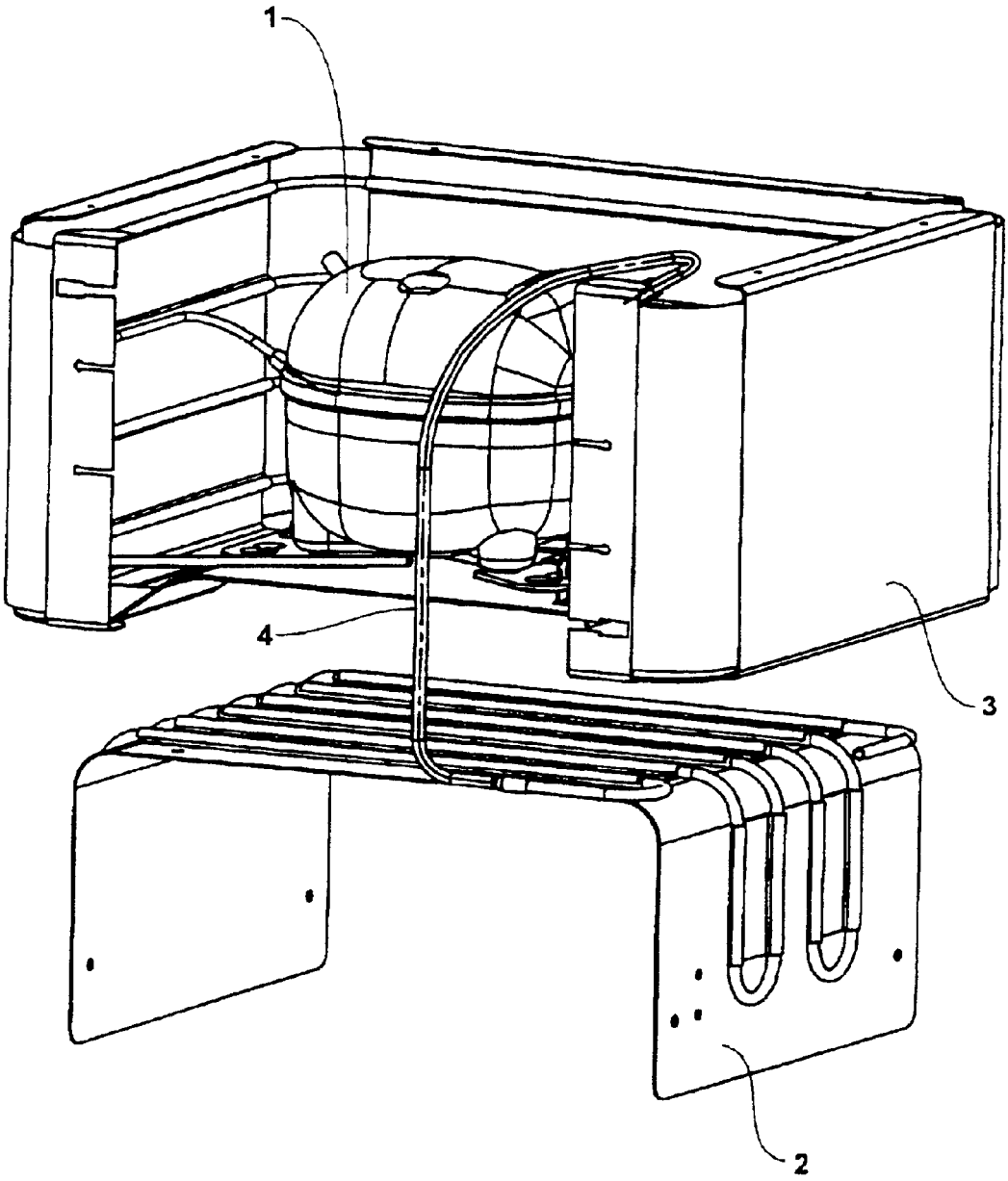
FIG. 1 illustrates, schematically and in a partially exploded perspective view, a constructive form for the sealed unit of the present invention, in the mounting operative position.
Figure 2:
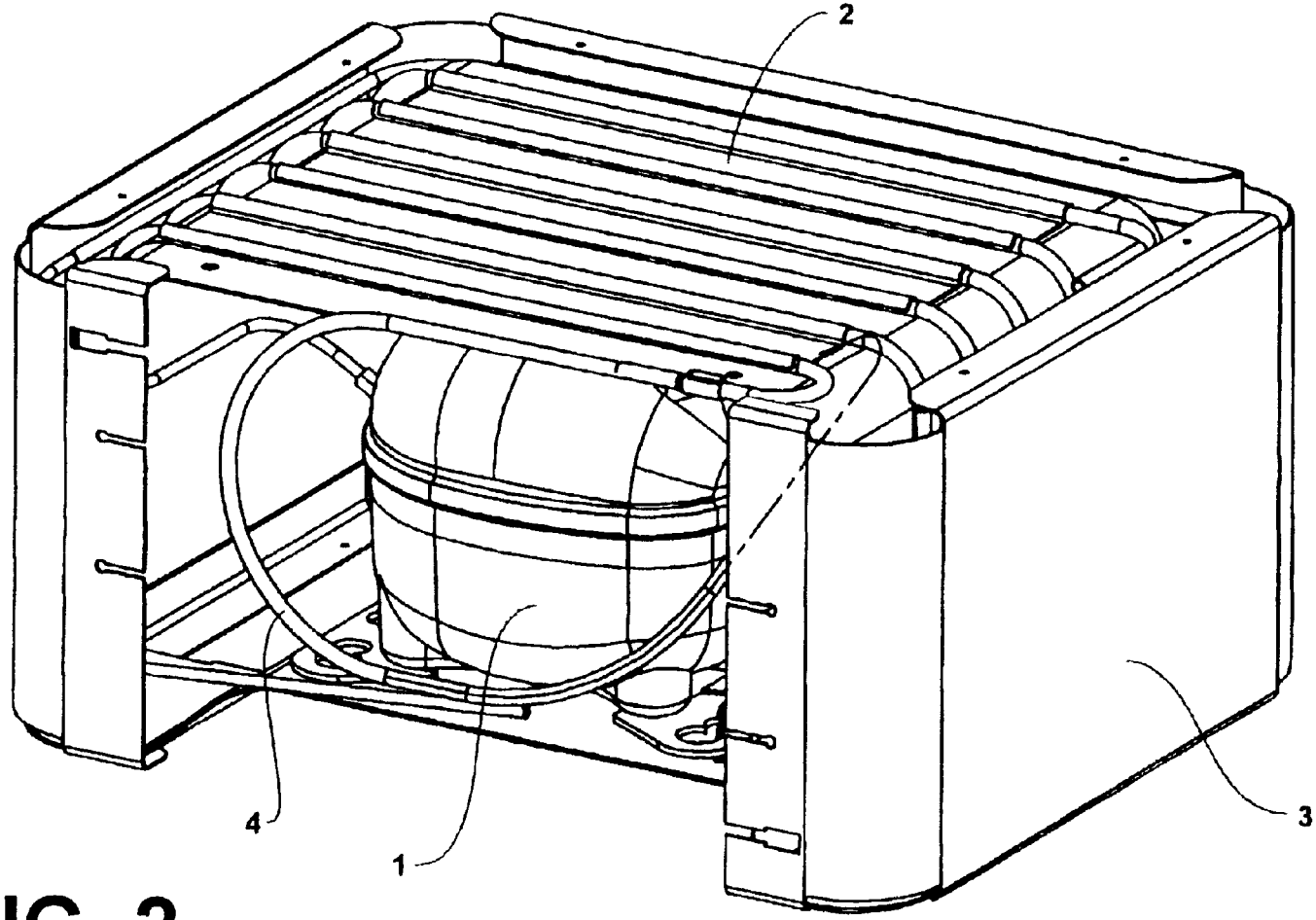
FIG. 2 illustrates, schematically, a perspective view of the sealed unit of FIG. 1 in the inoperative position of transportation.
Figure 3:
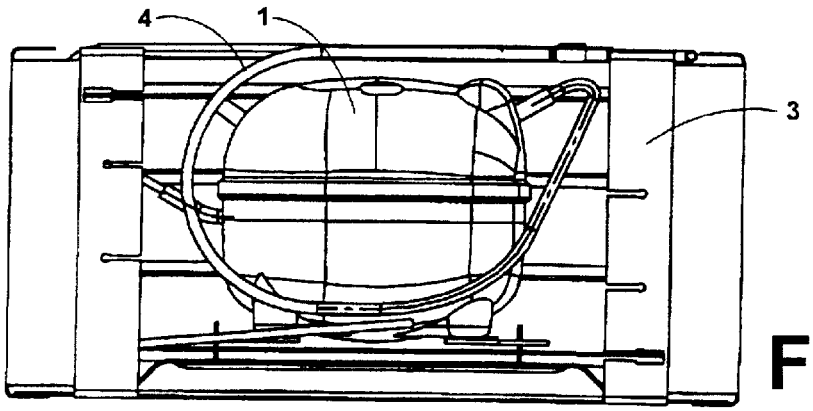
FIG. 3 illustrates, schematically and in a front view, the sealed unit of FIG. 2.
Figure 4:
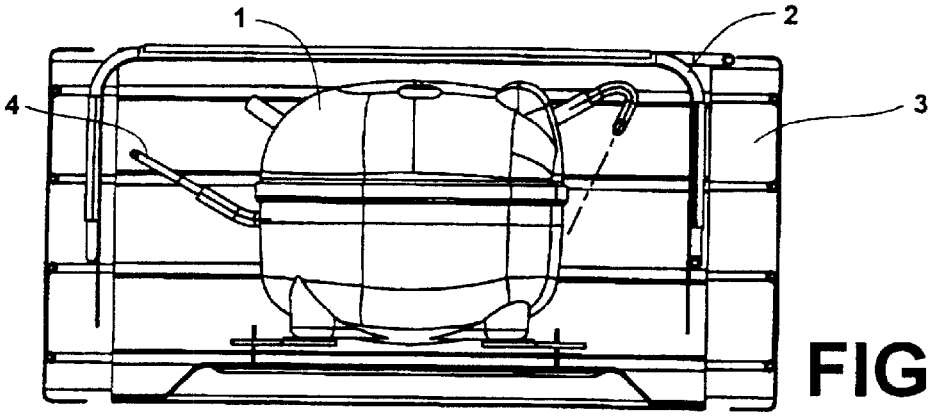
FIG. 4 illustrates, schematically and in a vertical longitudinal view, the sealed unit of FIG. 3, in the inoperative position of transportation.
Figure 5:
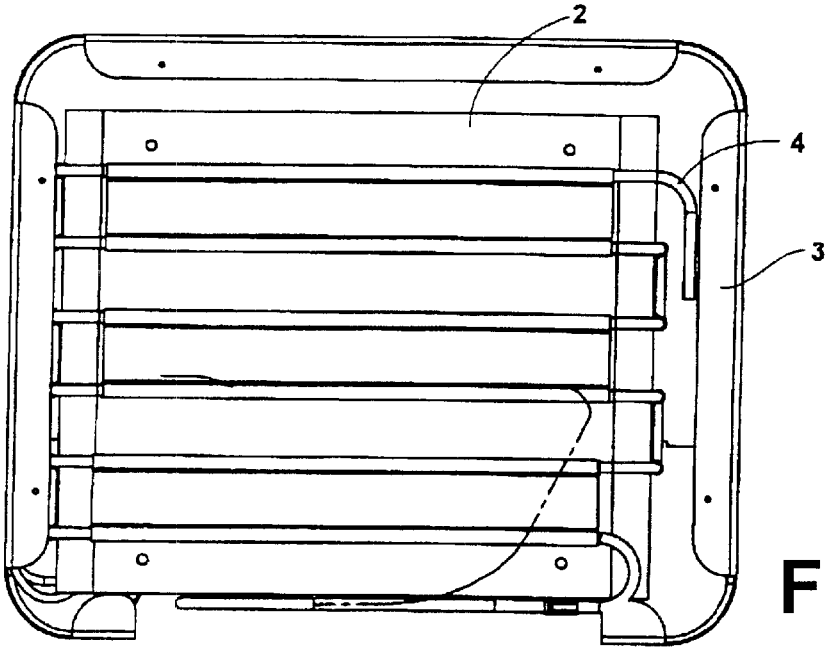
FIG. 5 illustrates, schematically, an upper view of the sealed unit of FIG. 2.

The present invention will be described in relation to a refrigeration appliance comprising a sealed unit including component parts defined by a hermetic compressor 1, an evaporator 2, a condenser 3, and conducting tubes 4 of refrigerant fluid, connecting the hermetic compressor 1 to the condenser 3, the latter to the evaporator 2 by means of a expanding device (not illustrated), and connecting said evaporator to the hermetic compressor 1, closing a hermetic refrigeration circuit for the refrigerant fluid.

According to the present invention, the sealed unit may be compacted, in order to present an inoperative position of transportation generally used for taking said sealed unit to a station where it will be mounted into a respective cabinet of a refrigeration appliance, and an operative position, in which it is mounted to said respective cabinet and in which the evaporator 2 is usually provided more distant from the assembly formed by the hermetic compressor 1 and the condenser 3.

In the inoperative position, the hermetic compressor 1 and the conducting tubes 4 are contained inside a structure defined by at least one of the other components defined by the evaporator 2 and the condenser 3 of the sealed unit.

According to the present invention, at least one of the parts consisting of the evaporator 2 and the condenser 3 is defined by a prismatic body, which is at least partially tubular and which defines the compact structure of the sealed unit in its inoperative position.

In the inoperative position of the sealed unit, the hermetic compressor 1 and the conducting tubes 4 are contained inside a contour defined by the contour of at least one of the parts consisting of the evaporator 2 and the condenser 3. In the construction in which one of said parts defines said contour, said part receives the other of said parts in one of the conditions of said other part being seated against and placed within said contour.

In the illustrated solution, the hermetic compressor 1 and the conducting tubes 4 are entirely contained within the prismatic body defined by the polygonal contour of the condenser 3, against which is superiorly seated the evaporator 2. The tubes are made, for example, of a plastically deformable metallic material, such as copper or aluminum, and may include, both internally and coaxially, a capillary tube portion. In the illustrated construction, the evaporator 2 has a "U" profile and the condenser 3 a "C" profile, and the parts consisting of the evaporator 2 and the condenser 3 are dimensioned so that the evaporator 2 can be fitted in an inverted "U" position inside the condenser 3, for obtaining the inoperative position of transportation. In a way of carrying out the present invention, the evaporator 2 and the condenser 3 are of the tube-plate type.

In the operative position, the sealed unit usually has the hermetic compressor 1 and the condenser 3 closer to each other than in relation to the evaporator 2 and the conducting tubes 4 connecting the hermetic compressor 1 to the evaporator 2 are substantially elongated or placed in the vertical position, as in the case of the vertical refrigeration appliances.

In order to be placed in its inoperative position, the sealed unit has the evaporator 2 and the conducting tubes 4 conducted to the inside of the contour of the condenser 3, so that said conducting tubes 4 are disposed around the compressor, which is already disposed inside said contour. The conducting tubes 4 are previously submitted to a plastic deformation, which gives them, so that they may fit inside the contour of the condenser, a curvature and a helical profile defined as a function of the space available inside the structure of the contour of the condenser 3.

With the construction for the sealed unit of refrigerant fluid proposed above, the volume occupied by said sealed unit is reduced, facilitating its transportation.

What is claimed is:

1. A sealed unit of refrigerant fluid for a refrigeration appliance, comprising component parts defined by a hermetic compressor (1), a condenser (3), an evaporator (2) and conducting tubes (4) of refrigerant fluid, connecting the hermetic compressor (1) to the condenser (3), the latter to the evaporator (2) by means of an expanding device, and connecting the evaporator (2) to the hermetic compressor (1), at least one of the parts consisting of the condenser (3) and the evaporator (2) being defined as a prismatic body which is at least partially tubular, said component parts of the sealed unit being relatively displaced from an inoperative position of transportation, in which the hermetic compressor (1) and the conducting tubes (4) remain contained within a contour defined by the contour of at least one of the parts defined by the condenser (3) and the evaporator (2), to a mounting operative position in a refrigeration appliance, in which the evaporator (2) and part of the extension of the conducting tubes (4) connecting the latter to the hermetic compressor (1) and to the condenser (3) are displaced to a position external to the condenser contour.

2. The sealed unit of claim 1, characterized in that the hermetic compressor (1) and the conducting tubes (4) are entirely contained inside the prismatic body.

3. The sealed unit of claim 2, characterized in that the hermetic compressor (1) and the conducting tubes (4) are entirely contained inside the condenser (3).

4. The sealed unit of claim 1, characterized in that, in the inoperative position, one of the parts defined by the condenser (3) and the evaporator (2) receives the other of said parts in one of the conditions of said other part being seated against and placed within the contour defined by said part.

5. The sealed unit of claim 1, characterized in that the conducting tubes (4) are collapsed in the inoperative position, in order to be placed inside the prismatic contour around the hermetic compressor (1) and to reach, in the operative position, a substantially elongated position, to be mounted to the refrigeration appliance.

6. The sealed unit of claim 5, characterized in that the connecting tube (4) connecting the hermetic compressor (1) to the evaporator (2) is made of a plastically deformable metallic material.

7. The sealed unit of claim 6, characterized in that said conducting tube (4) includes, internally and coaxially, a capillary tube portion.

8. The sealed unit of claim 6, characterized in that the conducting tubes (4) are made of one of the materials defined by copper and aluminum.

9. The sealed unit of claim 4, characterized in that the evaporator (2) has a "U" profile and the condenser (3) a "C" profile, the evaporator (2) and the condenser (3) being dimensioned so that the evaporator (2) may fit in an inverted "U" position inside the condenser (3).

10. The sealed unit of claim 1, characterized in that at least one of the parts defined by the evaporator (2) and the condenser (3) are of the tube-plate type.

* * * * *